US006702627B2

(12) United States Patent
Nankou et al.

(10) Patent No.: US 6,702,627 B2
(45) Date of Patent: Mar. 9, 2004

(54) CONNECTOR AND A METHOD OF ASSEMBLING IT

(75) Inventors: Yuuichi Nankou, Yokkaichi (JP); Ryotaro Ishikawa, Yokkaichi (JP); Hajime Kawase, Yokkaichi (JP); Toshikazu Sakurai, Yokkaichi (JP); Yukihiro Fukatsu, Yokkaichi (JP); Shinya Fujita, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/316,221

(22) Filed: Dec. 10, 2002

(65) Prior Publication Data

US 2003/0176114 A1 Sep. 18, 2003

(30) Foreign Application Priority Data

Mar. 15, 2002 (JP) ..... 2002-072785
Jun. 14, 2002 (JP) ..... 2002-174924

(51) Int. Cl.[7] ..... H01R 13/436
(52) U.S. Cl. ..... 439/752
(58) Field of Search ..... 439/752, 595

(56) References Cited

U.S. PATENT DOCUMENTS 5,378,176 A 1/1995 Sasai
5,647,777 A * 7/1997 Sasai et al. ..... 439/752
5,651,703 A 7/1997 Sasai
5,980,333 A * 11/1999 Nakamura et al. ..... 439/752
6,280,262 B1 * 8/2001 Tanaka ..... 439/752
6,461,203 B2 * 10/2002 Todo ..... 439/752
6,497,591 B2 * 12/2002 Fujita ..... 439/752

FOREIGN PATENT DOCUMENTS

JP 4-322079 of 1992

* cited by examiner

*Primary Examiner*—Gary Paumen
(74) *Attorney, Agent, or Firm*—Anthony J. Casella; Gerald E. Hespos

(57) ABSTRACT

A connector has a housing (1) and retainer mount hole (8) is open in the housing (1) from its bottom surface over to its opposite side surfaces. Upon being moved from a partial locking position to a full locking position, A retainer (7) can be moved from a partial locking position to a full locking position and is guided obliquely forward by guides (22–25). Thus, the retainer (7) can be constantly guided to a specified position regardless of a variation in the fitted position of the retainer (7) in the retainer mount hole (8) along forward and backward directions. Since the retainer (7) and terminal fittings (4) can constantly have a proper positional relationship, a problem of a varying function of the retainer (7) to detect the insufficiently inserted states of the terminal fittings (4) due to a variation in the fitted position of the retainer (7) can be solved.

7 Claims, 17 Drawing Sheets

CONNECTOR AND A METHOD OF ASSEMBLING IT

BACKGROUND OF THE INVENTION

1. Field of the Invention

The invention relates to a connector and to a method of assembling it.

2. Description of the Related Art

A side-retainer connector has a housing with a plurality of parallel cavities for receiving terminal fittings. A retainer mount hole is formed in one side surface of the housing and extends substantially normal to the cavities. A retainer can be pushed into the hole to lock the terminal fittings in the cavities.

Side-retainer connectors provide secure locking because the retainer is aligned substantially normal to the inserting direction of the terminal fittings. However, connectors of this type still have room for improvement.

For example, clearances are set between the retainer mount hole and the retainer, including a dimension along the inserting direction of the terminal fittings. These clearances are necessary to push the retainer smoothly. However, a retainer mount position may vary forward or backward along the inserting direction of the terminal fittings due to such clearances.

Similar clearances are set between the retainer and the retainer mount hole and permit the retainer to tilt. A retainer that tilts backward while at a most forward position in the mount hole may interfere with the terminal fittings even though the terminal fittings are inserted to a proper depth. Thus, an insufficiently inserted state of the terminal fittings may be detected erroneously.

Conversely, a retainer that tilts forward while at a rearmost position in the retainer mount hole may not interfere with the terminal fittings even though the terminal fittings are inserted insufficiently: In such a case, the insufficiently terminal fittings may not be detected.

The present invention was developed in view of the above problem and an object thereof is to detect the inserted states of terminal fittings.

SUMMARY OF THE INVENTION

The invention relates to a connector with a housing that is connectable with a mating connector housing. The housing has at least one cavity and a terminal fitting is insertable in the cavity along an inserting direction. The cavity may be parallel to the connecting direction of the housing and mating housing. A retainer mount hole is formed in the housing and communicates with the cavity. The mount hole is formed at an intermediate longitudinal position of the housing and opens to three sides. A retainer can be pushed into the mount hole to engage and lock the terminal fitting. The retainer and/or the housing has guide means for guiding the retainer oblique to the inserting direction of the terminal fitting and for pushing the terminal fitting to the proper depth.

A lock in the cavity can lock a terminal fitting that has been inserted to the proper depth. The lock preferably is resiliently deformable and cooperates with the retainer to achieve double locking.

The retainer is displaced from an initial position at a rear side of the retainer mount hole to a final mount position at the front side of the retainer mount hole along the inserting direction of the terminal fitting.

A terminal fitting may be inserted only lightly and therefore may be distanced from its proper depth. Such a terminal fitting immediately interferes with the retainer when an attempt is made to move the retainer from its initial position. Thus, the insufficiently inserted state can be detected. However, a terminal fitting may be only slightly before the proper depth. In this situation, the retainer pushes the terminal fitting and guides the terminal fitting to the proper depth as the retainer is moved obliquely from the initially position. The retainer then locks the terminal fitting in a proper state.

The guide for guiding the retainer obliquely to the inserting direction of the terminal fitting may be on the portion of the retainer held in sliding contact with the housing when the retainer is pushed into the retainer mount hole.

The retainer is movable forward and back in the retainer mount hole. Therefore, the function of the retainer to detect insufficient insertion is not hindered by a variation in the fitted position of the retainer unlike the prior art.

The retainer preferably comprises two opposed side plates that face opposite side surfaces of the housing. Guides are provided along a pushing direction of the retainer where the side plates and the housing face each other. The guides enable the retainer to be mounted in a proper posture and pushed without being inclined.

The retainer mount hole preferably is formed by cutting off the housing in an area extending from a surface that substantially faces the pushing direction of the retainer over to side surfaces substantially normal to and adjacent the surface that faces the pushing direction. However, the sides of the retainer substantially close openings in the opposite side surfaces of the housing made by the retainer mount hole. As a result, the sides of the retainer also serve as the outer walls of the housing, and the housing can be narrower than a housing that does not have a retainer mount hole in both side surfaces.

The retainer preferably is mounted in the housing for movement between partial and full locking positions. Insertion and withdrawal of the terminal fittings are permitted when the retainer is in the partial locking position. However, the retainer engages and locks the terminal fitting when the retainer is moved to the full locking position. A clearance preferably is defined between the retainer and the retainer mount hole so that an inserted state of the terminal fitting into the cavity can be seen through the clearance when the retainer is at the partial locking position. However, the retainer substantially closes the clearance when the retainer reaches the full locking position so that external matter cannot enter into the housing.

The retainer may comprise two spaced apart side plates. Additionally, either one of the facing surfaces of the side plates and the housing are formed with guide grooves that extend oblique to the inserting direction of the terminal fitting. The other of the side plates and the housing are formed with locking projections that align with the guide grooves and move along the extending direction of the guide grooves. Thus, the retainer is pushed in the oblique pushing direction and can be guided by the displacement of the locking projections in the guide grooves.

The cavities may be arranged at a plurality of stages in the housing and may be adapted to accommodate the terminal fittings inserted from behind.

The retainer can be moved longitudinally forward and backward in the retainer mount hole. Thus, a variation in the fitted position of the retainer does not hinder the ability of the retainer to detect the insufficiently inserted terminal fittings, and the insufficiently inserted terminal fitting can be corrected automatically. As a result, it is not necessary to reinsert the terminal fitting.

The locks may comprise ribs that can be held substantially in sliding contact with edges of the guide grooves. Locking means are provided at the surfaces of the side plates and those of the housing for engaging each other when the retainer is at a position for locking the terminal fittings.

A push-preventing projection may be provided at the rear of each locking projection with respect to the pushing direction of the retainer. Each locking projection may engage one end of the corresponding guide groove and the push-preventing projection may engage the other end of the corresponding guide groove when the retainer is at the partial locking position. Additionally, each locking projection preferably engages the other end of the corresponding guide groove and the push-preventing projection is disengaged from the guide groove and outside the retainer when the retainer is in the full locking position. Accordingly, a return movement of the retainer can be prevented by the locking projections and an inadvertent movement of the retainer to the full locking position can be prevented by the push-preventing projections.

The invention also relates to a method of assembling a connector. The method comprises inserting a terminal fitting along an inserting direction and into a cavity of a connector housing. The method then comprises pushing a retainer into a mount hole of the housing to engage and lock the terminal fitting in the housing. The pushing step includes guiding the retainer obliquely to the inserting direction of the terminal fitting, and thereby pushing an insufficiently inserted terminal fitting to the proper depth in the cavity. The retainer mount hole is at an intermediate longitudinal position of the housing and is open to three sides. The pushing step includes closing at least parts of the mount hole by the retainer as the retainer is pushed into the mount hole.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
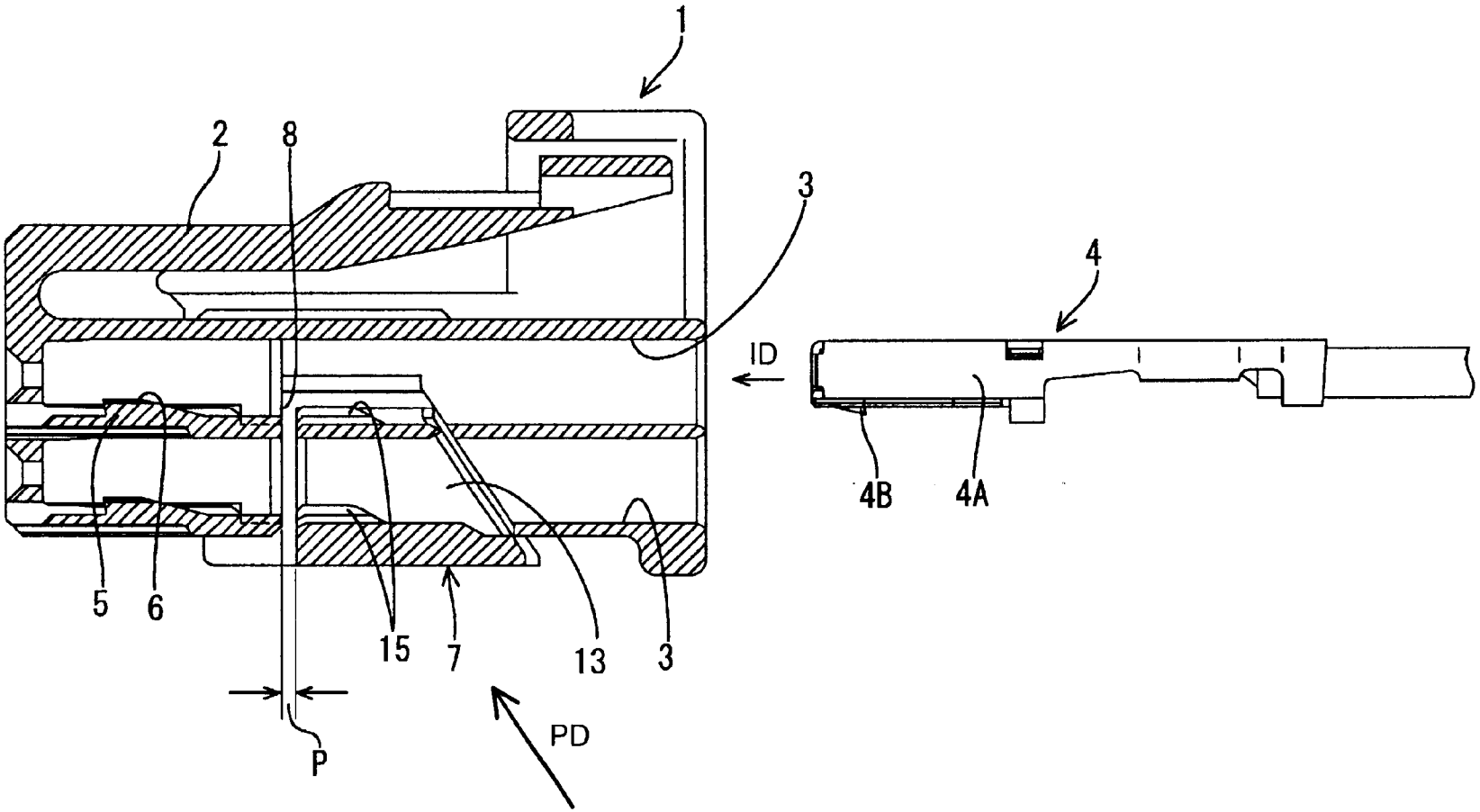
FIG. 1 is a section showing a stare before a terminal fitting is inserted with a retainer partly locked.
Figure 2:
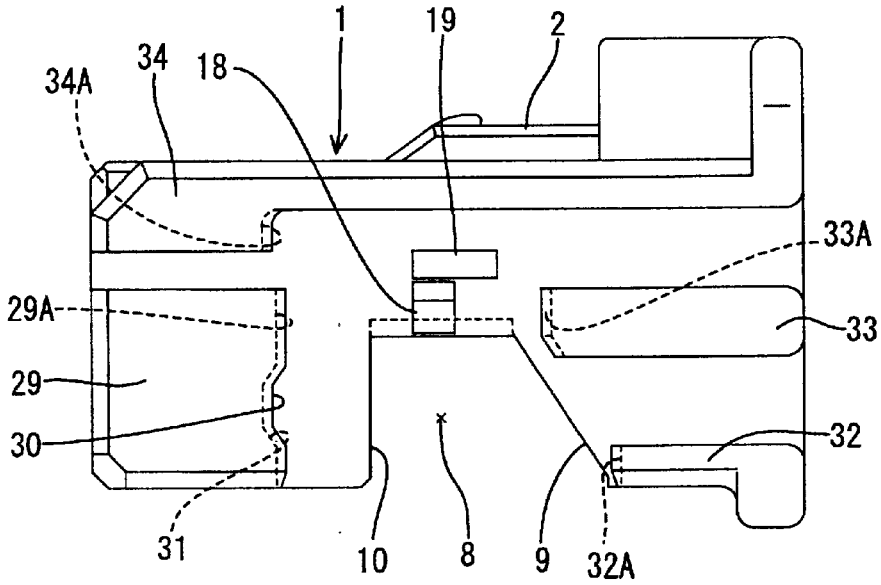
FIG. 2 is a side view of a connector housing.
Figure 3:
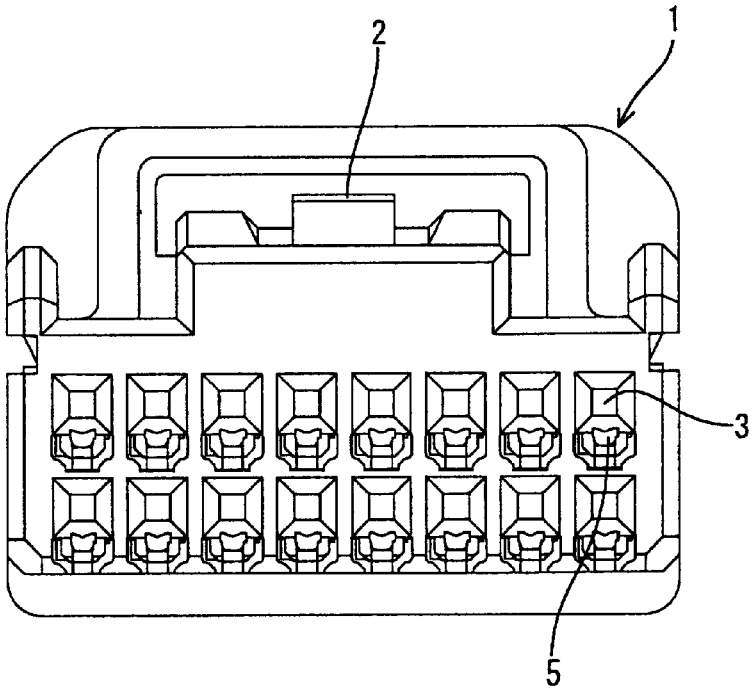
FIG. 3 is a front view of the connector housing.
Figure 4:
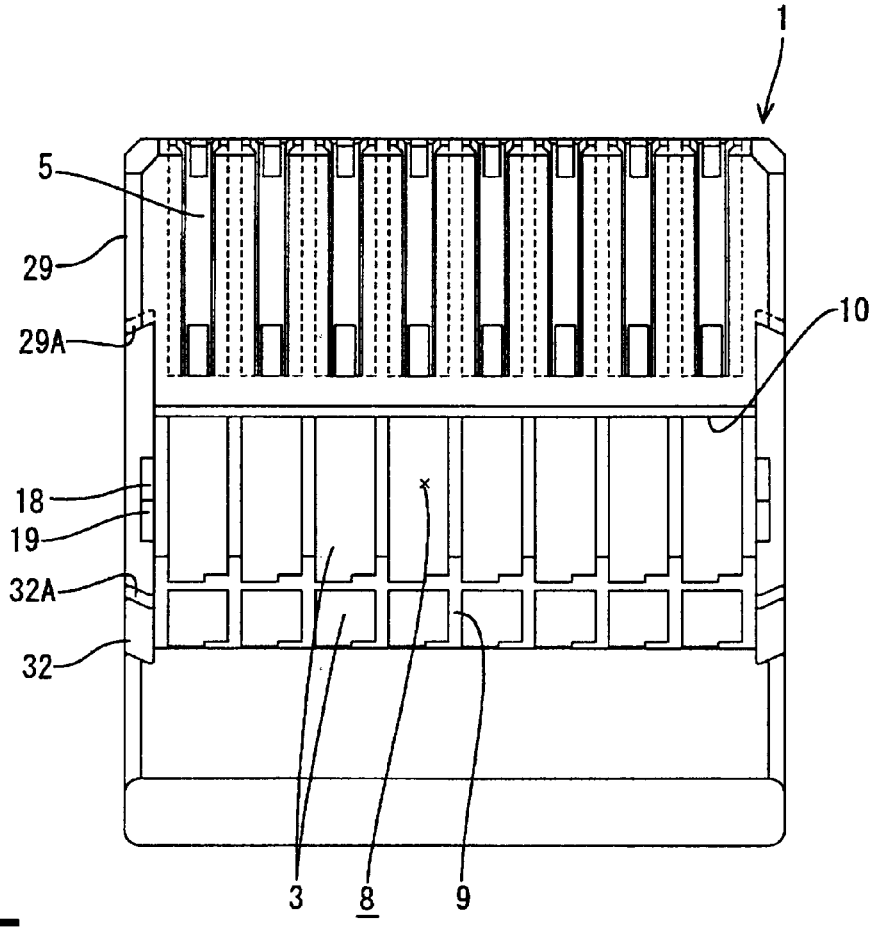
FIG. 4 is a bottom view of the connector housing.

A connector according to the subject invention includes a housing identified by the numeral 1 in FIG. 1. The housing 1 is formed of a synthetic resin and has an upper surface with a resiliently deformable lock arm 2. The lock arm 2 is supported at one end and is engageable with an unillustrated mating housing to lock the two housings in a connected state.

Cavities 3 are provided at upper and lower stages inside the housing 1 and penetrate the housing 1 longitudinally along forward and backward directions. Terminal fittings 4 can be inserted from behind into the respective cavities 3, and locks 5 are provided at the front sides of the bottom surfaces of the respective cavities 3 for partly locking the terminal fittings 4. Each lock 5 extends substantially along the inserting direction ID of the terminal fitting 4 and has both front and rear ends supported. A lock projection 6 is formed on the upper surface of each lock 5. The terminal fitting 4 has a box 4A and a locking projection 4B projects from the box 4A. The locking projection 4B of the terminal fitting 4 pushes the lock projection 6 as the terminal fitting 4 is inserted into the cavity 3 and hence deforms the lock 5 down. The locking projection 4B eventually passes the lock projection 6, and the lock 5 is restored resiliently so that the lock projection 6 engages the locking projection 4B.

A synthetic resin retainer 7 is mountable in a retainer mount hole 8 in a bottom of the housing 1 substantially opposite the lock arm 2 and at an intermediate longitudinal position of the housing 1. The terms top and bottom, as used herein, are to provide a frame of reference and do not imply a required gravitational orientation. The retainer mount hole 8 is formed by cutting away an area of the housing 1 including areas of the bottom surface and side surfaces of the housing 1. Accordingly, the retainer mount hole 8 is open at three sides, i.e. the bottom side and the opposite lateral sides of the housing 1 and divides the respective upper and lower cavities 3 into front and rear sections and substantially exposes them to outside.

The retainer mount hole 8 has a slanted rear surface 9 and a vertical front surface 10. The slanted rear surface 9 is sloped forward along the inserting direction ID of the terminal fittings 4, while the vertical front surface 10 is aligned substantially normal to the inserting direction ID.

Figure 5:
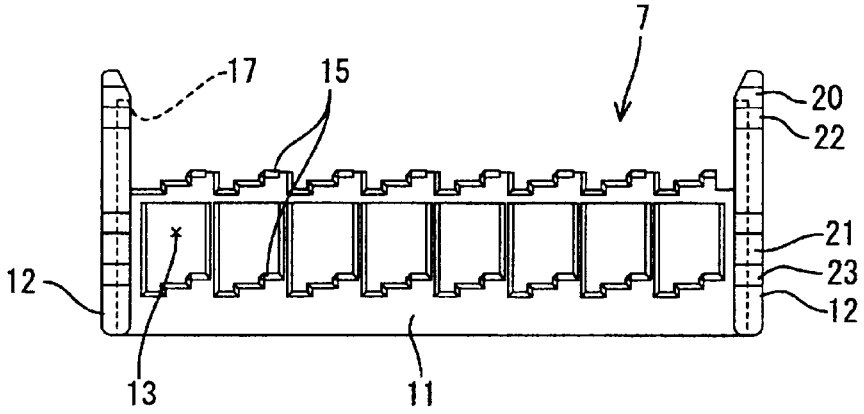
FIG. 5 is a front view of a retainer.
Figure 6:
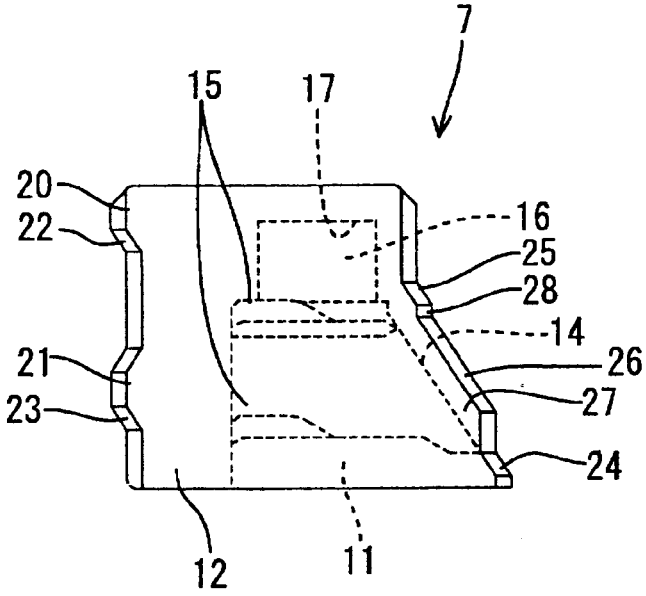
FIG. 6 is a side view of the retainer.

The retainer 7, as shown most clearly in FIGS. 5 and 6, has a main body 11 and side plates 12 at opposite ends of the main body 11. The main body 11 can be aligned with and fit in the retainer mount hole 8. The main body 11 is substantially lattice-shaped and has windows 13 that are alignable with the respective cavities 3 at the lower stage when the retainer 7 is at a partial locking position in the housing 1 (see FIG. 1). A slanted surface 14 is defined at the rear of the main body 11 and has an inclination that substantially conforms to the slanted surface 9 of the retainer mount hole 8. Locking projections 15 project at the bottom ends of the respective windows 13 of the main body 11 and also at positions on the upper surface of the main body 11 for engaging the terminal fittings 4.

The side plates 12 are spaced from one another by a distance that substantially corresponds to the spacing between the opposite side surfaces of the housing 1. The side plates 12 are larger than side openings made in the side surfaces of the connector housing 1 by the retainer mount hole 8. Thus, the side plates 12 substantially close the corresponding side openings of the retainer mount hole 8 and project out from the edges of the side openings of the retainer mount hole 8 regardless of whether the retainer 7 is at the partial locking position or at the full locking position. Accordingly, the side plates 12 also serve as outer sidewalls of the housing 1.

A substantially rectangular recess 16 is formed at the inner surface of each side plate 12 above the main body 11, and a locking edge 17 is defined at the upper edge of the recess 16. The locking edges 17 can hold the retainer 7 at the partial and full locking positions in the housing 1 as follows (see FIGS. 7 and 8). Specifically, a partial locking projection 18 and a full locking projection 19 are located one over the other above each side opening of the retainer mount hole 8 in the connector housing 1, as shown in FIGS. 7, 8, 10 and 12. However, the full locking projections 19 are wider than the partial locking projections 18. The front edges of the partial locking projections 18 contact the front edges of the recesses 16 (see FIG. 10) when the retainer 7 is at the partial locking position, and thus restrict a backward movement in a direction opposite to the pushing direction PD of the retainer 7. Further, the rear edges of the full locking projections 19 contact the rear edges of the recesses 16 (see FIG. 12) when the retainer 7 is moved to the full locking position to restrict a forward movement of the retainer 7 in the pushing direction PD.

Figure 7:
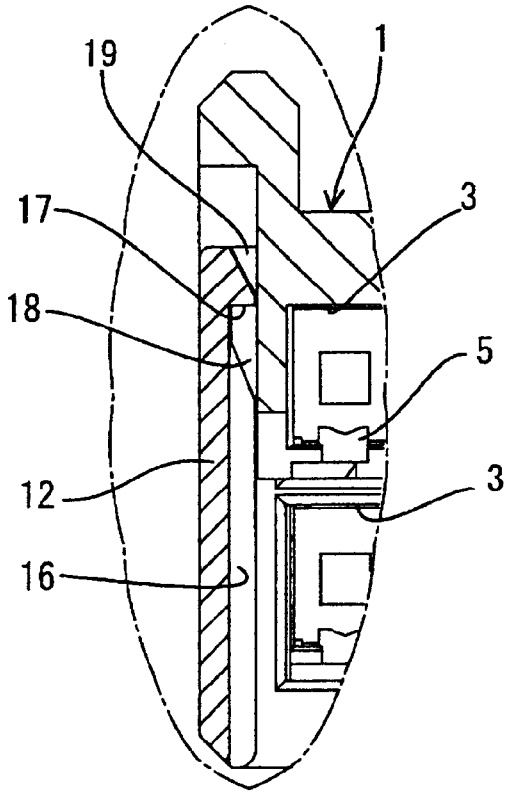
FIG. 7 is an enlarged section showing an essential portion of the partly locked retainer.
Figure 8:
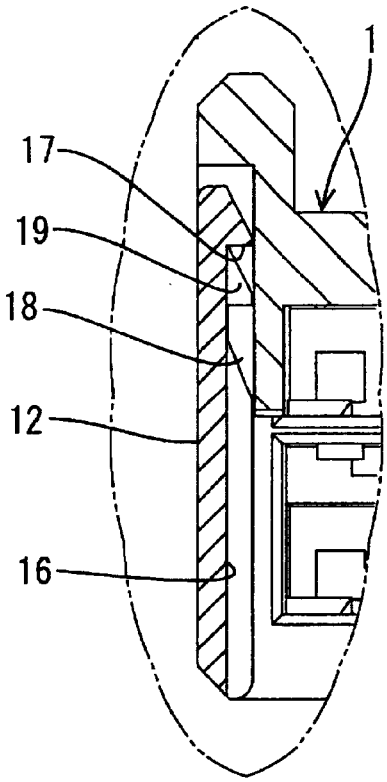
FIG. 8 is an enlarged section showing an essential portion of the fully locked retainer.
Figure 9:
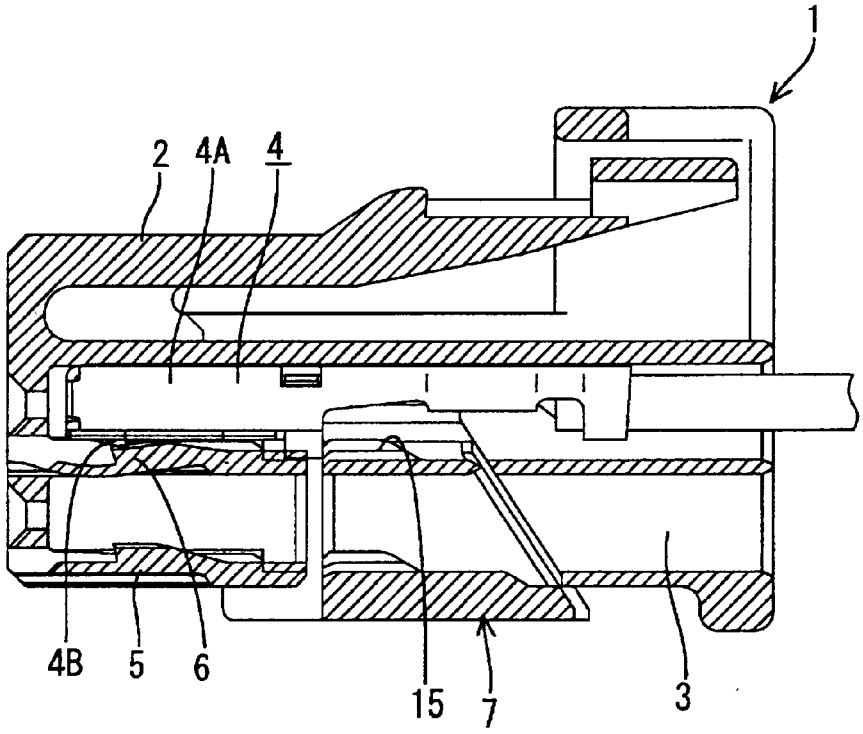
FIG. 9 is a section showing a state where the terminal fitting is inserted with the retainer partly locked.

The locking edges 17 of the retainer 7 can engage the partial locking projections 18 on the housing 1 to hold the retainer 7 at the partial locking position shown in FIG. 7. In this position, the locking projections 15 of the retainer 7 are outside the cavities 3, and the terminal fittings 4 can pass through the windows 13 in both inserting and withdrawing directions ID. Alternatively, the locking edges 17 can engage the full locking projections 19 to hold the retainer 7 in the full locking position shown in FIG. 8. In this position, the locking projections 15 enter the cavities 3 and engage the rear ends of the boxes 4A of the terminal fittings 4. Accordingly, the retainer 7 and the locks 5 cooperate for doubly locking the terminal fittings 4 in the cavities 3.

Guiding surfaces 22 to 25 are formed on the front and rear edges of each side plate 12 to guide the retainer 7 along the pushing direction PD and oblique to the inserting direction ID of the terminal fittings 4 into the housing 1. Specifically, the front edge of each side plate 12 extends substantially normal to the inserting direction ID, and projections 20, 21 are formed at upper and lower positions on the front edge. Upper and lower front guide surface 22 and 23 are formed on the bottoms of the respective upper and lower projections 20, 21 and slope forwardly. Lower and upper rear guide surfaces 24 and 25 are formed along the rear edge of each side plate 12. A slanted surface 26 is formed on a stepped projection 27 continuous with and above the lower rear guide surface 24. An upright surface 28 extends from the stepped projection 27 to the upper rear guide surface 25 and a vertical edge extends up from upper rear guide surface 25 substantially normal to the inserting direction ID.

The guide surfaces 22 to 25 and the slanted surface 26 of the stepped projection 27 all have an inclination substantially equal to the inclination of the slanted surface 9 of the retainer mount hole 8. Thus, the guide and slanted surfaces 22–26 guide movements of the retainer 7 between the partial and full locking positions. Specifically, front guides 29 project from portions of the outer side surfaces of the housing 1 that face the front edges of the side plates 12. A fittable recess 30 is formed in the rear edge of each front guide 29 and has a shape that substantially conforms to the outer shape of the lower projection 21. Accordingly, the fittable recess 30 is engageable with the lower projection 21 when the retainer 7 reaches the full locking position. A receiving edge 31 is formed at the bottom end of each front guide 29. The receiving edges 31 slide in contact the lower front guide surfaces 23 of the retainer 7 and guide the retainer 7 as the retainer 7 is pushed to the full locking position. During this time, the rear-upper corner portions of the front guides 29 are held in sliding contact with the upper front guide surfaces 22 (see FIG. 10).

Rear lower guides 32 project at the outer side surfaces of the housing 1 behind the side openings of the retainer mount hole 8, and the front bottom ends thereof are held in sliding contact with the lower rear guide surfaces 24 of the retainer 7 when the retainer 7 is moved from the partial locking position to the full locking position. Rear middle guides 33 project above the rear lower guides 32 at the side surfaces of the housing 1, and front bottom corners thereof are cut off for sliding contact with the upper rear guide surfaces 25 of the retainer 7.

The front and rear edges of each side plate 12 of the retainer 7 are beveled over the entire height and taper toward the outer side. On the other hand, dovetail grooves 29A, 32A, 33A, 34A are formed at portions of the front guide 29, the rear lower guide 32, the rear middle guide 33 and an upper projection 34 that face the corresponding side plate 12. The beveled edges of the side plates 12 slide in the dovetail grooves 29A, 32A, 33A, 34A to prevent the side plates 12 from opening wider.

A specified clearance "P" exists between the front end of the retainer 7 and the front end of the retainer mount hole 8 when the retainer 7 is at the partial locking position of FIG. 1. The inserted states of the terminal fittings 4 can be seen through the clearance from outside the housing 1.

Figure 10:
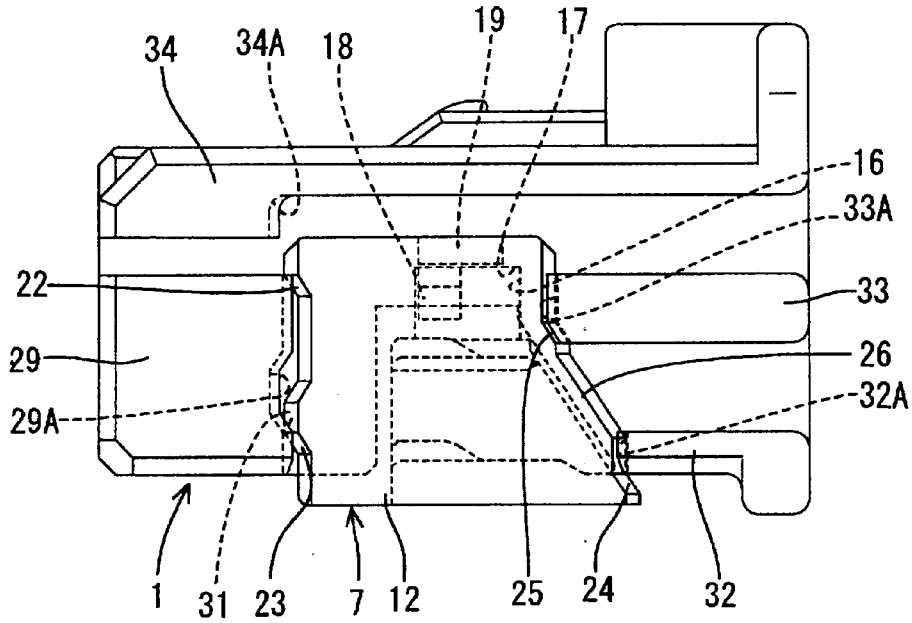
FIG. 10 is a side view of a connector with the retainer partly locked.
Figure 11:
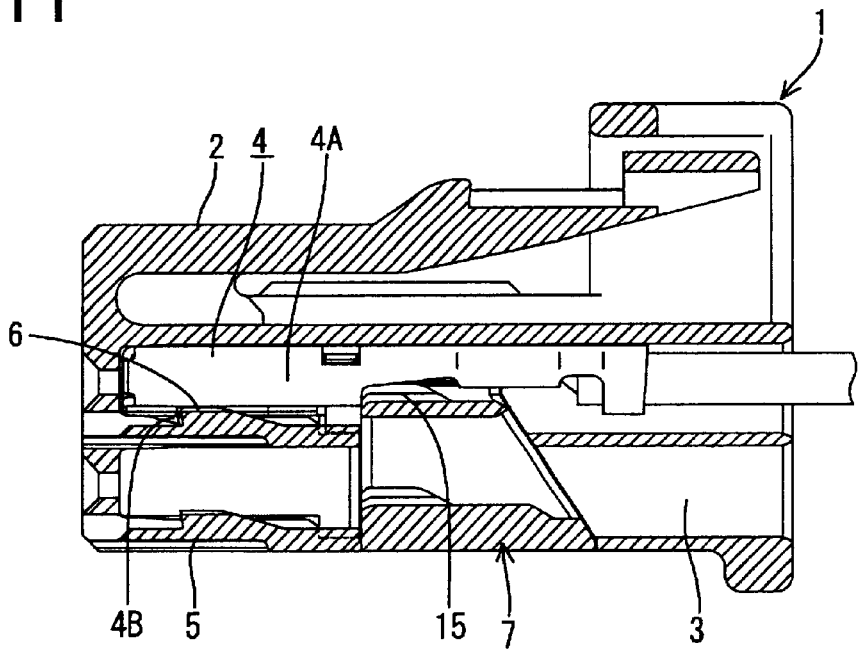
FIG. 11 is a section of the connector with the retainer fully locked.
Figure 12:
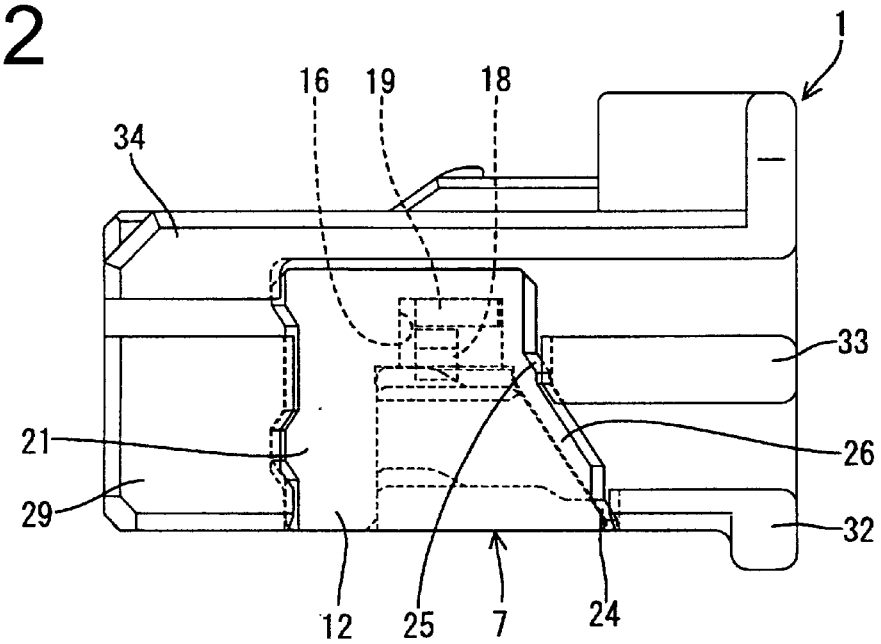
FIG. 12 is a side view of the connector with the retainer fully locked.
Figure 13:
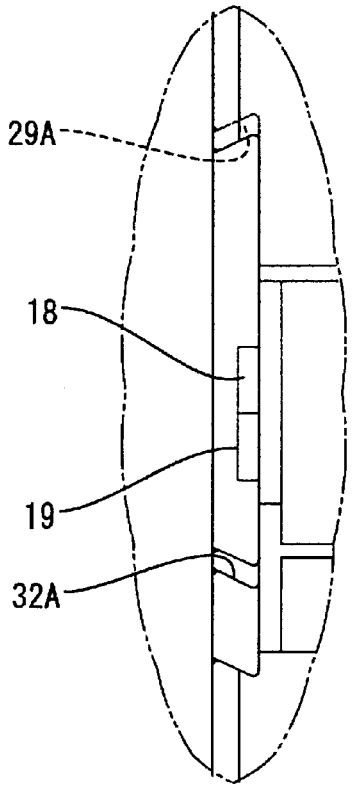
FIG. 13 is an enlarged view showing an essential portion of an engaged state of a side plate 12 and a mount groove.

The terminal fittings 4 are inserted into the respective cavities 3 with the retainer 7 at the partial locking position, as shown in FIGS. 1 and 10. The locking projection 4B of the terminal fitting 4 pushes the lock projection 6 of the lock 5 during the insertion process and deforms the lock 5. However, the lock 5 is restored resiliently after the locking projection 4B passes the locking projection 6 and the locking projection 6 engages the locking projection 4B for partial locking. The specified clearance P exists between the front end of the retainer 7 and the front end of the retainer mount hole 8 when the retainer 7 is at the partial locking position, and the insides of the cavities 3 can be seen through the clearance P. Thus, a visual inspection can determine that the terminal fittings 4 have been inserted.

The main body 11 of the retainer 7 then is pushed to move the retainer 7 in the pushing direction PD and into the retainer mount hole 8. The pushing direction is oblique to the inserting direction ID so that the retainer 7 has a movement component in the inserting direction ID. The locking edges 17 move beyond the partial locking projections 18 and engage the full locking projections 19 to hold the retainer 7 at the full locking position. The locking projections 15 of the retainer 7 enter the corresponding cavities 3 when the retainer 7 reaches the full locking position to engage the rear ends of the boxes 4A of the terminal fittings 4. Thus, the locks 5 and the retainer 7 doubly lock the terminal fittings 4. At this stage, the retainer 7 closes the opening of the mount hole 8 formed in the bottom surface of the housing 1 to prevent dust and the like from entering the cavities 3.

The retainer 7 moves obliquely forward between the partial and full locking positions and is guided by sliding contact of the lower front guide surfaces 23 with the receiving edges 31, sliding contact of the upper front guide surfaces 22 with the upper corners of the front guides 29, sliding contact of the lower rear guide surfaces 24 with the front bottom ends of the rear lower guides 32 and sliding contact of the upper rear guide surfaces 25 and the front corners of the rear middle guides 33. Accordingly, the oblique movement of the retainer 7 in the pushing direction PD causes the locking projection 15 to push the rear end of the box 4A of any terminal fitting 4 that had been inserted insufficiently. Thus, any terminal fitting 5 left insufficiently inserted is pushed automatically to its proper position.

The retainer 7 interferes with the box 4A of a terminal fitting 4 that is not inserted sufficiently to be pushed into the fully inserted position. Thus, an operator can detect the insufficiently inserted state of the terminal fitting 4.

As described above, the retainer 7 moves forward in the retainer mount hole 8 as the retainer 7 is moved from the partial to full locking positions. Additionally, the retainer 7 is guided to a specified position at the front of the retainer mount hole 8 regardless of a variation in the fitted position of the retainer 7. Additionally, the retainer 7 is supported on the housing 1 by the guide surfaces 22 to 25 at the front, rear and upper and lower sides while being moved from the partial locking position to the full locking position and can be pushed in a stable posture without being inclined or misaligned. Therefore, the mounted retainer 7 and the terminal fittings 4 are engaged with a proper positional relationship and a function of detecting the inserted states of the terminal fittings 4 is displayed efficiently.

The front and rear edges of the opposite side plates 12 engage the dovetail grooves 29A, 32A, 33A, 34A in the guides 29, 32, 33, 34 to prevent the side plates 12 from opening away from the housing 1 while the retainer 7 is moved from the partial locking position to the full locking position. Thus, the retainer 7 can be moved smoothly and securely by the guide surfaces 22 to 25. The retainer mount hole 8 is open in the side surfaces of the housing 1, and the side plates 12 of the mounted retainer 7 close the side openings. In other words, the side plates 12 of the retainer 7 serve as the outer walls of the sides of the housing 1, and the connector can be narrower than a connector in which the retainer mount hole 8 is not open in the side surfaces and the side plates 12 of the retainer 7 are placed on the side surfaces of the housing 1.

The retainer 7 and the housing 1 can be molded in the same mold, and the retainer 7 can be mounted at the partial locking position in the mold.

Figure 14:
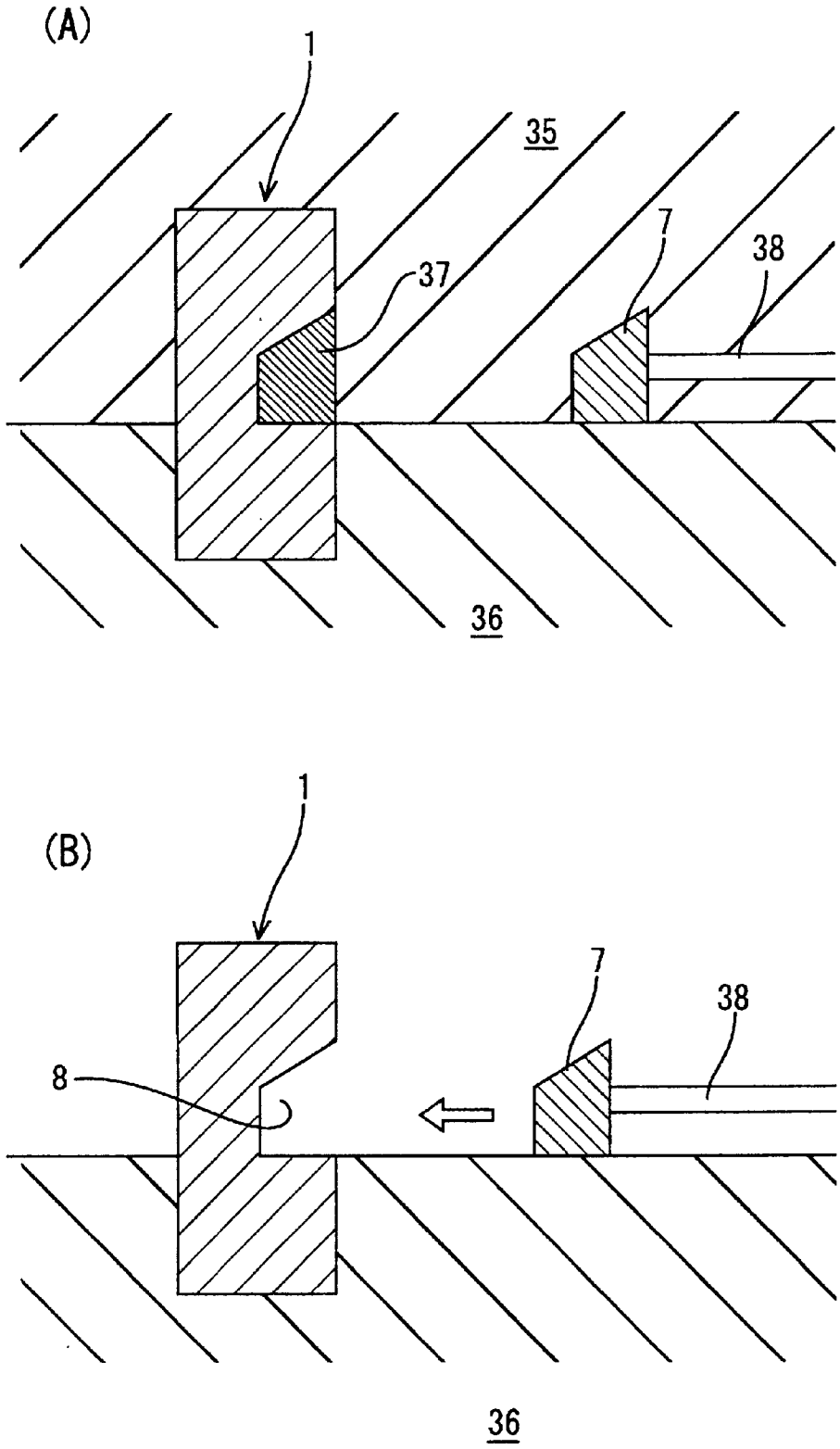
FIGS. 14(A) and 14(B) are sections diagrammatically showing how the connector housings and the retainer are molded.
Figure 15:
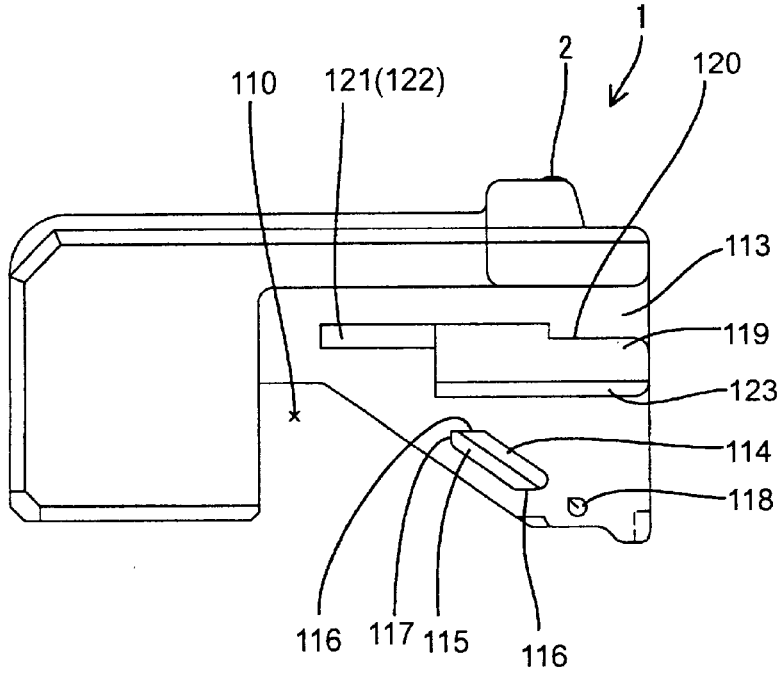
FIG. 15 is a front view of a connector housing.
Figure 16:
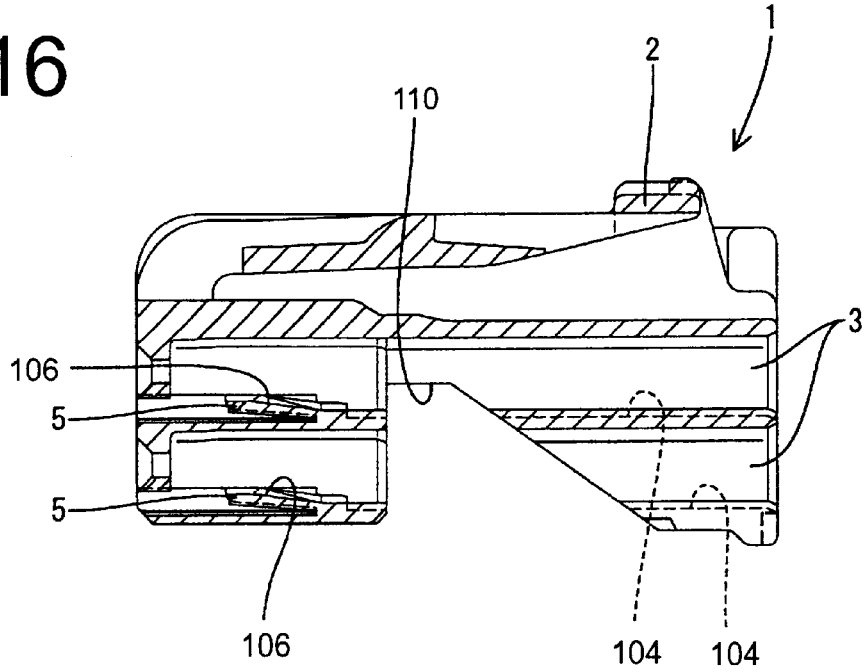
FIG. 16 is section of the connector housing.
Figure 17:
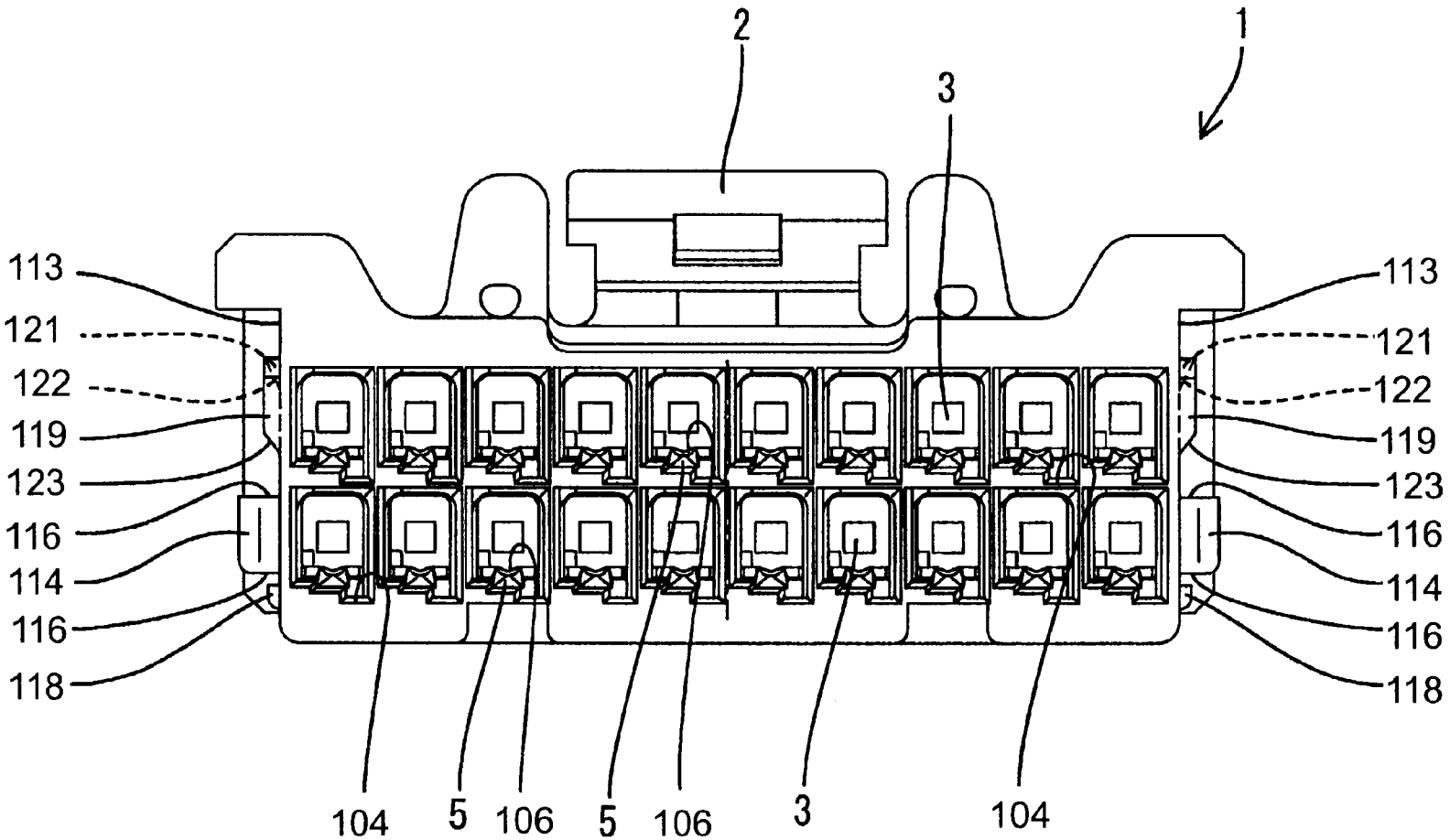
FIG. 17 is a rear view of the connector housing.
Figure 18:
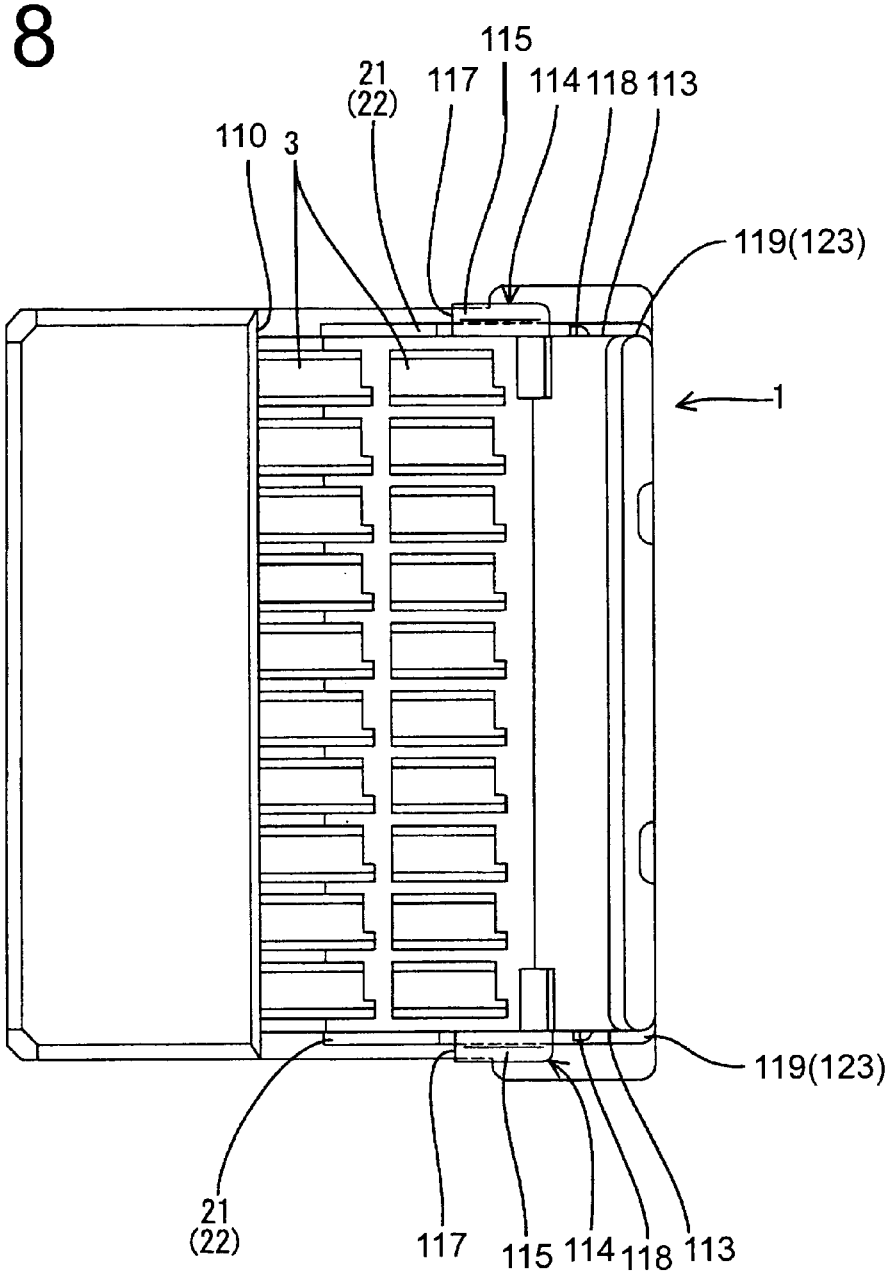
FIG. 18 is bottom view of the connector housing.
Figure 19:
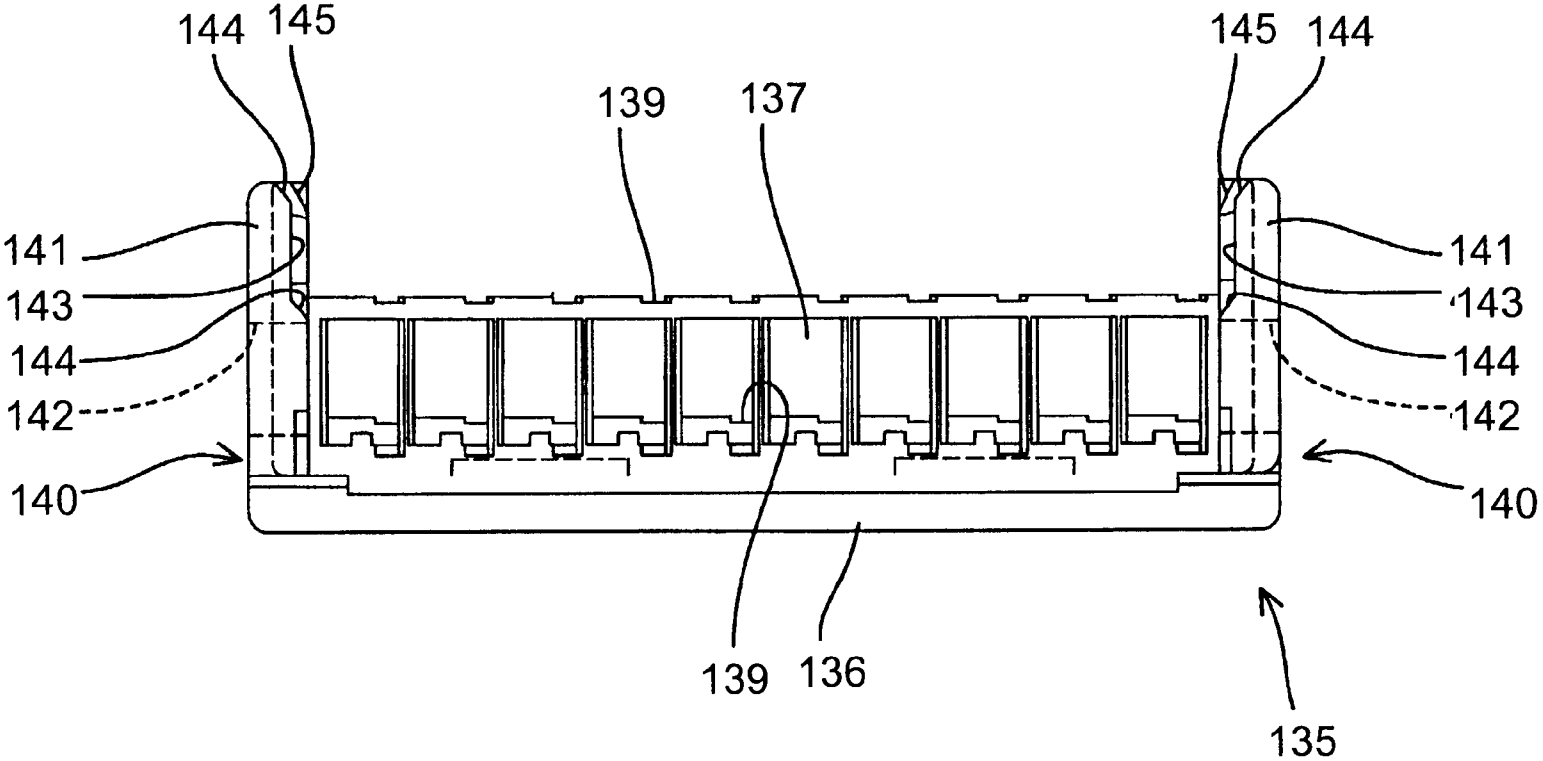
FIG. 19 is a side view of a retainer.
Figure 20:
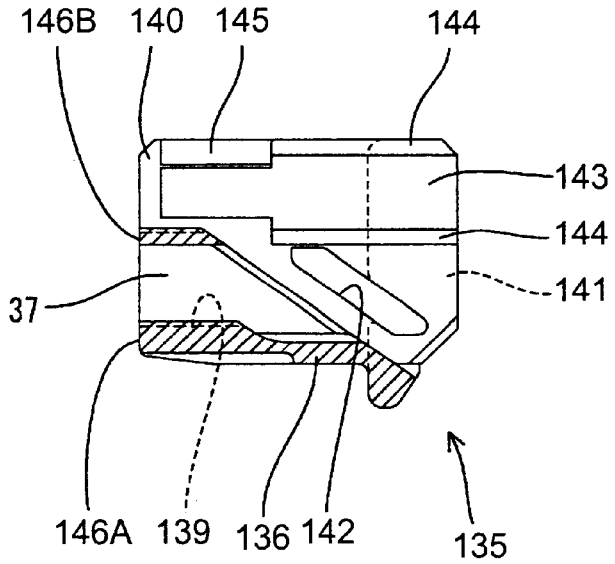
FIG. 20 is a front view in section of the retainer.
Figure 21:
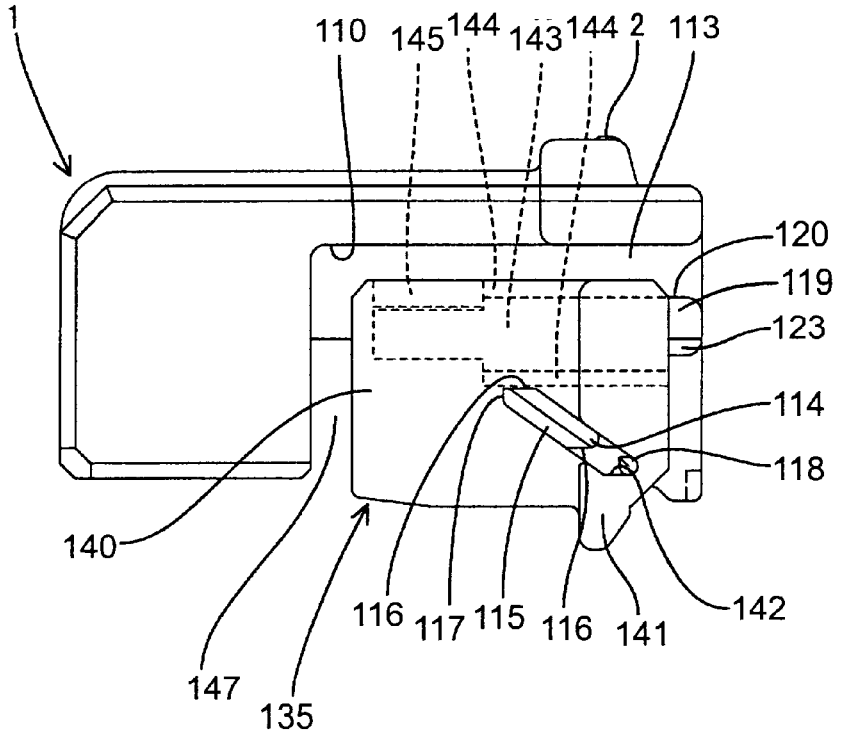
FIG. 21 is a front view of a connector when the retainer is partly locked.
Figure 22:
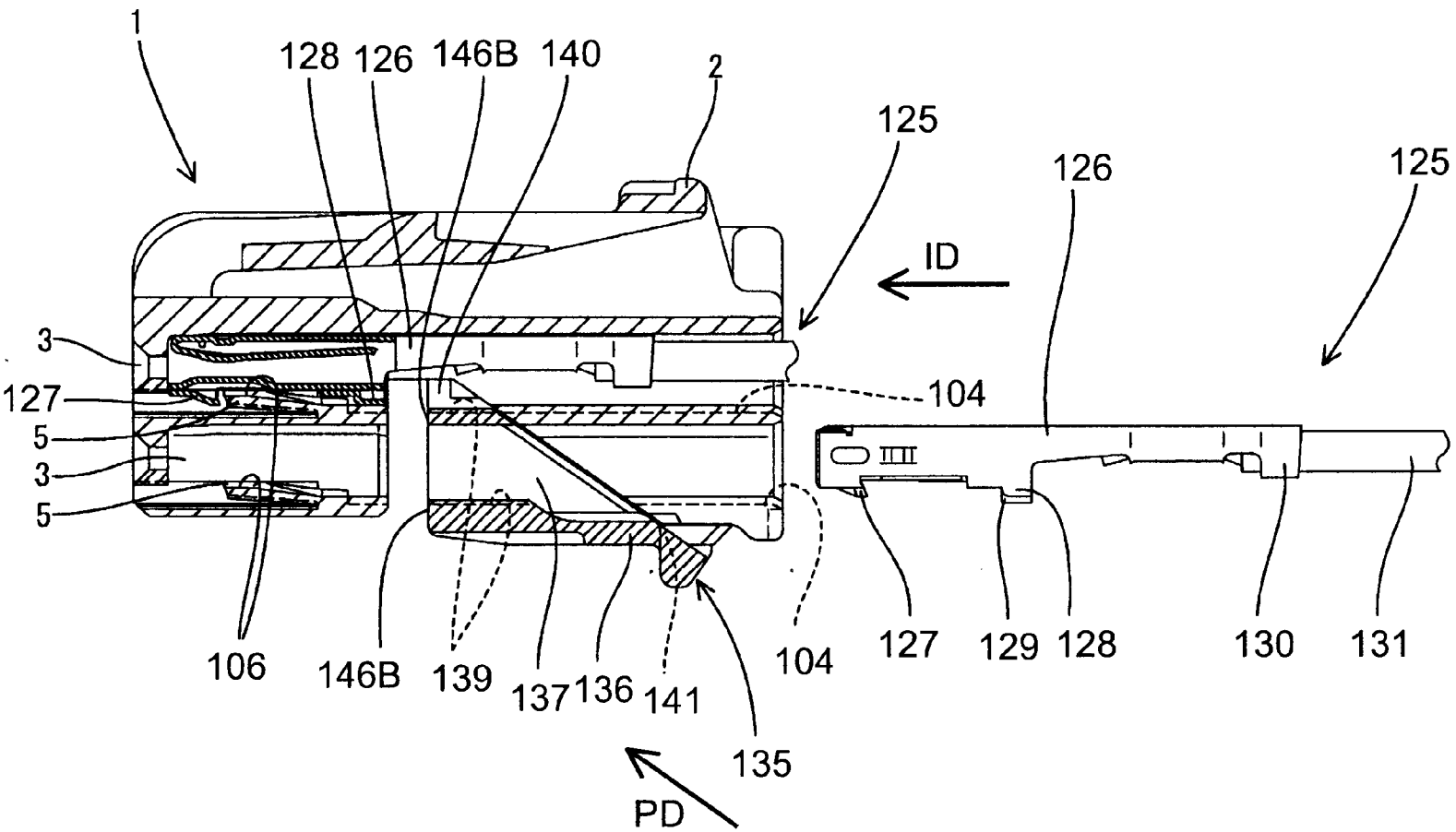
FIG. 22 is a section of the connector when the retainer is partly locked.
Figure 23:
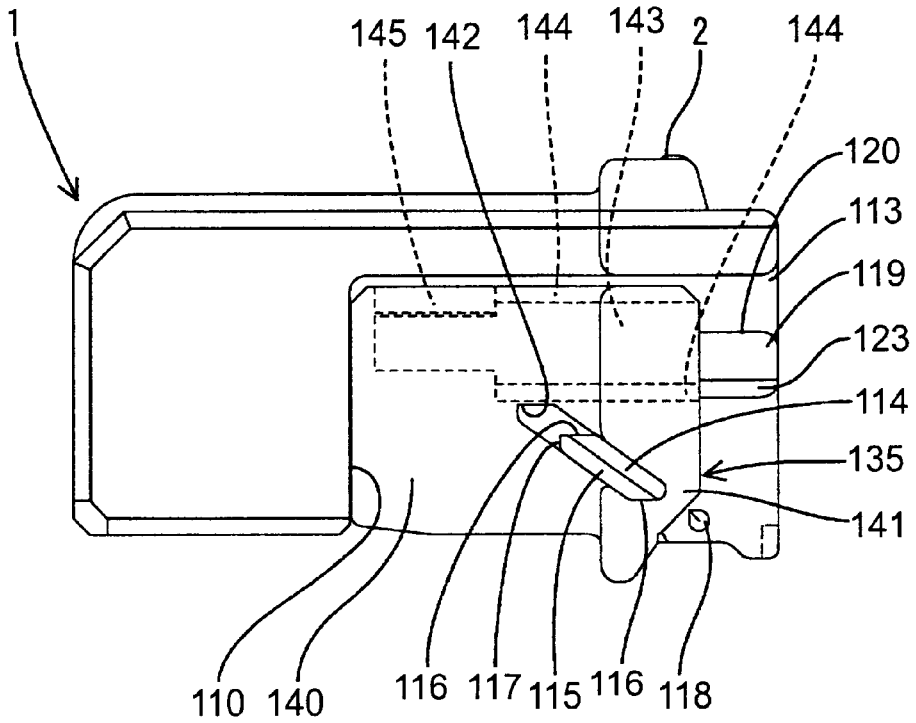
FIG. 23 is a front view of a connector when the retainer is fully locked.
Figure 24:
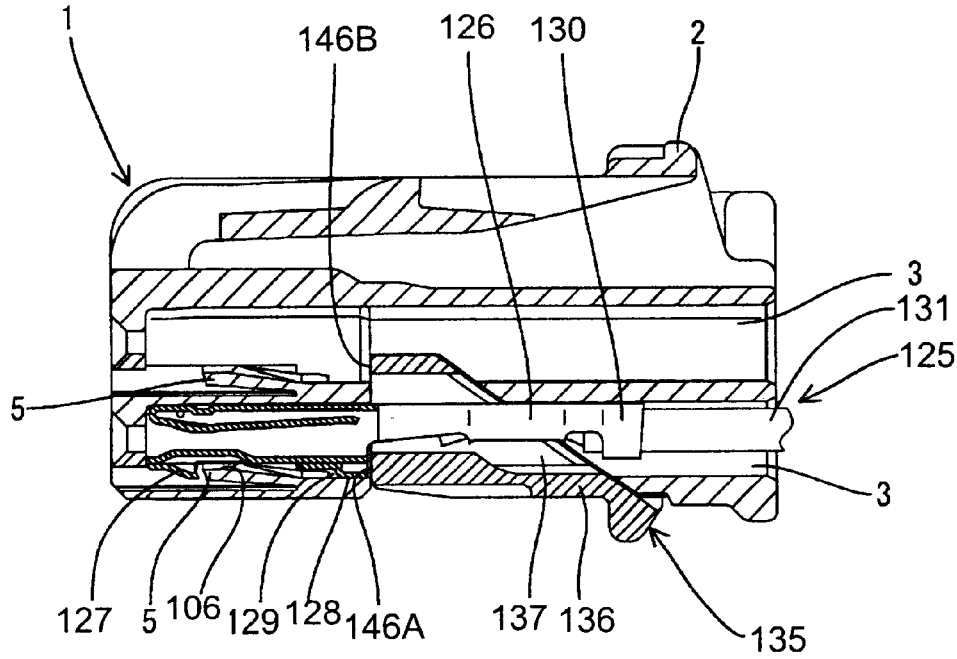
FIG. 24 is a section of the connector when the retainer is fully locked.
Figure 25:
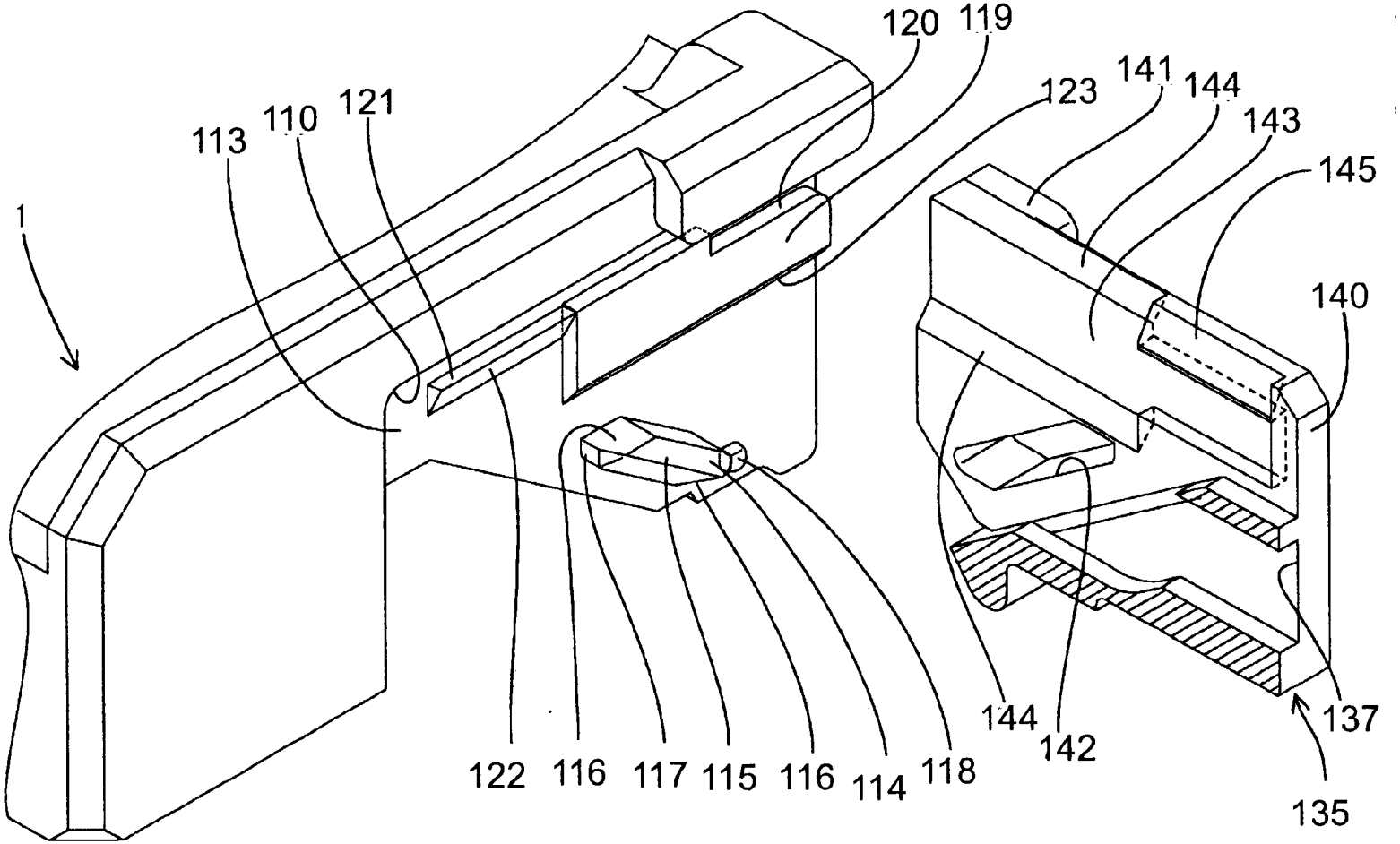
FIG. 25 is a perspective view enlargedly showing portions of the connector near a locking projection and a guide groove.

As described above, the retainer mount hole 8 is open in the opposite side surfaces of the housing 1. As shown in FIGS. 14(A) and 14(B), the entire housing 1 is formed by a pair of molds 35, 36 that open and close along the longitudinal direction of the cavities 3, and the retainer mount hole 8 is formed by a slidable mold 37 advanced and retracted substantially normal to the planes of FIGS. 14(A), 14(B). Further, the retainer 7 is formed in the same molds 35, 36 for the housing 1. The retainer 7 can be pushed toward the retainer mount hole 8 by a pushing pin 38 after the molds 35, 36 are opened, and can be mounted at its partial locking position. In other words, the connector can be assembled in the molds.

The retainer mount hole 8 has the side openings in the housing 1. Thus, a retainer forming portion cannot be provided in a movable area of the molds for forming the retainer mount hole 8. Accordingly, it is necessary to form the retainer 7 outside this movable area. The retainer then is moved to a position where it faces the opening of the retainer mount hole 8 after the molds 35, 36 for forming the retainer mount hole 8 are opened. This results in a complicated mold structure. In this respect, the connector of this embodiment can be assembled up to the mounting of the retainer 7 from this position in the molds having a simple structure.

A connector according to a second embodiment is illustrated in FIGS. 15 to 25, and includes a housing 1 unitarily formed from a synthetic resin. A resiliently deformable lock arm 2 is cantilevered from the middle of the upper surface of the housing 1. The lock arm 2 is engageable with an unillustrated mating connector housing to lock the housings together.

Cavities 3 are arranged along the widthwise direction at upper and lower stages inside the housing 1. The cavities 3 penetrate the housing 1 along forward and backward directions, and terminal fittings 125 can be moved along the inserting direction ID for insertion from behind into the cavities 3. Locks 5 are at the front sides of the bottom surfaces of the cavities 3 for partly locking the terminal fittings 125. Each lock 5 extends forward along the inserting direction ID and is supported at only one end. Thus, each lock 5 is resiliently deformabley vertically substantially normal to the inserting direction ID. The lock 5 is deformed down as the terminal fitting 125 is inserted. After sufficient insertion, the lock 5 is restored resiliently so that the front end of the lock 5 engages a locking projection 127 formed on the terminal fitting 125 to prevent the terminal fitting 125 from coming out. A projection-inserting groove 16 extends along forward and backward directions substantially in the middle of the upper surface of each lock 5, thereby reducing a degree of downward resilient deformation of the lock 5 during the passage of the terminal fitting 125. Thus, the entire connector can be shorter by reducing the clearances between the locks 5 and the bottom surfaces of the cavities 3.

The terminal fitting 125 is formed by bending, folding and/or embossing a metal plate stamped or cut into a specified shape. A box-shaped main portion 126 is formed at the front of the terminal fitting 125 and is connectable with a tab of a mating male terminal fitting. A barrel 130 is formed at the rear end of the terminal fitting 125 for connection with a wire 131. A front end of the bottom surface of the main portion 126 is embossed or cut and bent at a middle position to form the locking projection 127. A rear end of the surface with the locking projection 127 also is embossed or cut and bent substantially in the middle to form a projection 128. A stabilizer 129 extends at the side of the projection 128 and can be moved forward in an escaping groove 104 at one corner of the bottom surface of each cavity 3. The stabilizer 129 does not align with the escaping groove 104 when the terminal fitting 125 is inserted in an improper orientation. Thus improper insertion of the terminal fitting 125 can be prevented.

A retainer mount hole 110 is formed in the surface of the housing 1 opposite from the lock arm 2 and in the adjacent side surfaces. Accordingly, the retainer mount hole 110 is provided at an intermediate longitudinal position of the connector housing 1 and is open at three sides. Further, the retainer mount hole 110 has a depth sufficient to expose the cavities 3 at the upper stage so that the upper and lower cavities 3 are divided into front and rear sections. The opening edges of the respective cavities 3 all extend substantially vertically or normal to the inserting direction ID at the front surface of the retainer mount hole 110, but are inclined down to the back at an angle oblique with respect to the inserting direction ID of the terminal fittings 125 at the rear surface thereof.

A stepped surface 113 is recessed at an area of each side surface of the housing 1 above and behind the side opening of the retainer mount hole 110. A rib-shaped locking projection 114 is formed on the stepped surface 113 and extends substantially along the inclined side of the side opening of the retainer mount hole 110. A bevel 115 is formed entirely along the side of each locking projection 114 toward the retainer mount hole 110. The upper and lower end surfaces of each locking projection 114 are formed into horizontal surfaces 116, and a vertical surface 117 is substantially continuous with the upper horizontal surface 116.

A push-preventing projection 118 is formed on a downward extension line from each locking projection 114.

A shake-restricting portion 119 projects above the locking projection 114 on each stepped surface 113. Each shake-restricting portion 119 extends substantially horizontally along forward and backward directions and has a cut-away portion 120 on the upper edge so that a rear part is slightly narrower. A slanted surface 123 is formed over the entire bottom edge of each shake-restricting portion 119 and a hooking piece 121 projects before each shake-restricting portion 119. The hooking pieces 121 are formed such with upper edges that are substantially continuous with the upper edges of the corresponding shake-restricting portions 119. Slanted surfaces 122 are formed at the front of the hooking pieces 121 and incline forward and up.

The connector further includes a retainer 135 made e.g. of a synthetic resin similar to the housing 1, and is comprised of a main body 136 that is fittable into the retainer mount hole 110 and a pair of side plates 140 that bulge out at the opposite ends of the main body 136.

The main body 136 is formed with windows 137 that align with the respective cavities 3 at the lower stage of the housing 1. The front opening edges of the windows 137 extend vertically and align with the rear opening edges of the front sections of the respective cavities 3 divided by the retainer mount hole 110, whereas the rear opening edges thereof are inclined to conform to the inclination of the front opening edges of the rear sections of the cavities 3. Front parts and the upper surfaces of the main body 136 are at substantially the same height as the bottom surfaces of the corresponding cavities 3 when the retainer 135 is locked partly (FIG. 22) to permit insertion and withdrawal of the terminal fittings 125 in the inserting direction ID. However, rear parts of the bottom surfaces of the respective windows 137 are raised slightly. Front end surfaces 146A of the bottom walls of the windows 137 and front end surfaces 146B of the upper walls of the main body 136 are engageable with the projections 128 of the terminal fittings 125 when the retainer 135 is moved to the full locking position to lock the terminal fittings 125 doubly in cooperation with the locks 5.

Stabilizer inserting grooves 139 are formed in the bottom surfaces of the windows 137 and the upper surface of the retainer main body 136 for permitting the passage of the stabilizers 129 of the terminal fittings 125. However, the respective stabilizers 129 and the stabilizer inserting grooves 139 are displaced vertically from each other when the retainer 135 is moved to the full locking position. Thus, the rear end surfaces of the stabilizers 129 can engage the wall surface of the retainer 135 located below the front ends of the stabilizer inserting grooves 139.

The opposite side plates 140 of the retainer 135 have a spacing corresponding to the space between the opposite side surfaces of the housing 1 and are deformable in opening directions away from the housing 1 to widen the spacing. Opposite side plates 140 are dimensioned to substantially close side openings of the retainer mount hole 110 and face specified areas of the corresponding stepped surfaces 113 when the retainer 135 is locked fully. The thickness of the side plates 140 substantially equals the depth of the stepped surface 114 from the outer side surfaces of the housing 1, so that the side plates 140 are substantially flush with the corresponding outer surfaces of the housing 1 when the retainer 135 is locked fully. Thus, the side plates 140 of the retainer 135 also serve as the outer walls of the sides of the housing 1.

A thick operable portion 141 extends outwardly on the outer surface of the rear part of each side plate 140, and the bottom end thereof projects from the bottom surface of the retainer 135. Further, each side plate 140 is formed with a guide groove 142 behind the main body 136. Each guide groove 142 has substantially the same inclination as the rear opening edges of the respective windows 137 of the retainer 135, i.e. the front opening edges of the rear sections of the respective cavities 3 of the connector housing 1, and a bottom portion thereof is located in the operable portion 141. The guide grooves 142 have a width substantially equal to the shorter width of the locking projections 114 as measured normal to the pushing direction PD, and the opposite ends of the guide grooves 142 are shaped to substantially conform to the shapes of the opposite ends of the locking projections 114. The guide grooves 142 are engageable with both the locking projections 114 and the push-preventing projections 118 at their opposite ends to hold the retainer 135 at the partial locking position. The side plates 140 move onto the push-preventing projections 118 to bring the push-preventing projections 118 out of the guide grooves 142 while the retainer 135 is moved from the partial locking position to the full locking position. The side plates 140 are deformed in opening directions during this time. However, the projecting distance of the locking projections 114 is larger than that of the push-preventing projections 118 and is set at a value sufficient to keep the locking projections 114 engaged with the guide grooves 142 even if the side plates 140 are deformed to open wider. In this way, the retainer 135 reaches the fully locked state by moving the locking projections 114 toward the bottom ends of the guide grooves 142.

A restricting recess 143 is formed in the inner surface of each guide plate 140 above the guide groove 142 and receives the corresponding shake-restricting portion 119. Slanted surfaces 144 are formed on the upper and lower edges of the restricting recess 143. The restricting recess 143 is substantially rectangular and extends from a substantially middle position of the side plate 140 to the rear end along the insertion direction ID. The restricting recess 143 also extends from the upper end of the guide groove 142 to the upper end of the side plate 140 along the height direction, which is substantially normal to the inserting direction ID. Upper edges of the shake-restricting portions 119 and those of the restricting recesses 143 are held at a height where they substantially align with each other when the retainer 135 is locked partly and a specified clearance is defined between the lower edges of the shake-restricting portions 119 and those of the restricting recesses 143. The tapered surfaces 123 at the lower edges of the shake-restricting portions 119 substantially align with and contact the slanted surfaces 144 at the lower edges of the restricting recesses 143 when the retainer 135 is locked fully, thereby preventing the retainer 135 from making upward shaking movements.

The restricting recesses 143 extend further forward, and locking claws 145 are formed above these extended sections. The locking claws 145 are substantially at the same height as the hooking pieces 121 of the housing 1 and face the hooking pieces 121 when the retainer 135 is locked partly. However, the locking claws 145 move over the slanted surfaces 122 of the hooking pieces 121 to engage the upper edges of the hooking pieces 121 when the retainer 135 is locked fully, thereby holding the retainer 135 at the full locking position.

A specified clearance 147 is defined between the front end of the retainer 135 and the front end of the retainer mount hole 110 when the retainer 135 is locked partly. Thus, the inserted states of the terminal fittings 125 can be confirmed through the clearance 147 from outside of the housing 1.

The retainer 135 preferably is transported to a site of connecting connectors while being mounted at the partial locking position in the housing 1. The retainer 135 is mounted at the partial locking position by holding the opposite stepped surfaces 113 of the housing 1 from opposite sides by the side plates 140 of the retainer 135 while suitably opening the side plates 140, and fitting the locking projections 114 and the push-preventing projections 118 into the guide grooves 142. The locking projections 114 and the push-preventing projections 118 are engaged with the opposite ends of the guide grooves 142. Thus, the retainer 135 is positioned at the partial locking position and is prevented from inadvertent movement to the full locking position. The shake-restricting portions 119 are located in the restricting recesses 143 of the retainer 135 at the partial locking position. However, the specified clearances are defined between the bottom edges of the shake-restricting portions 119 and those of the restricting recesses 143 in this state.

The bottom surfaces of the respective windows 137 of the retainer 135 and the upper surface of the main body 136 are substantially flush with the bottom surfaces of the respective cavities 3 at the upper and lower stages with the retainer 135 partly locked. Accordingly, the terminal fitting 125 passes the retainer 135. The terminal fitting 125 then is pushed further into the cavity 3 along the insertion direction ID and contacts the lock 5 from behind. The locking projection 127 engages the projection-inserting groove 106 and causes the lock 5 to undergo a necessary and minimum deformation. Sufficient insertion causes the locking projection 127 to pass the lock 5. Thus, the lock is restored resiliently and engages the front-end surface of the lock 5. The specified clearance 147 is defined between the front end of the retainer 135 and the retainer mount hole 110 with the retainer 135 partly locked. As a result, the insides of the cavities 3 can be seen, and insertion of the terminal fittings 125 will not be forgotten.

Thereafter, the retainer 135 is pushed strongly by holding the operable portions 141. Then, portions of the retainer 135 near the bottom ends of the guide grooves 142 are deformed to move onto the push-preventing projections 18 and bring them out of the guide grooves 142, and the retainer 135 is pushed obliquely up in the pushing direction PD and is guided by the engagement of the locking projections 114 and the guide grooves 142. The locking projections 114 are held in sliding contact with the guide grooves 142 over a specified length during this time. Therefore, the retainer 135 can be pushed in a stable posture without being inclined or tilted in a clockwise direction in FIG. 21.

When the retainer 135 reaches the full locking position, the front end surfaces 146A of the bottom walls of the windows 137 and the front end surfaces 146B of the upper walls of the main body 136 are engageable with the projections 128 of the terminal fittings 125 to doubly lock the terminal fittings 125 in cooperation with the locks 5 inside the housing 1. At the full locking position, the locking projections 114 engage the bottom ends of the guide grooves 142, but the push-preventing projections 118 are located outside the operable portions 141. The locking claws 145 move over the slanted surfaces 122 of the hooking pieces 121 and engage the upper edges of the hooking pieces 121 at this time. Consequently, the retainer 135 is locked at the full locking position. Further, the bottom edges of the shake-restricting portions 119 engaged the bottom edges of the restricting recesses 143. Accordingly, the retainer 135 is prevented from making upward shaking movements.

The front surface of the retainer main body 136 substantially abuts the front surface of the retainer mount hole 110 when the retainer 135 reaches the fully locked state. Thus the retainer 135 substantially closes the retainer mount hole 110 without leaving any substantial clearance therebetween. Thus, dust and the like cannot enter into the cavities 3.

The terminal fitting 125 could be inserted insufficiently and left unlocked by the lock 5. This insufficiently inserted terminal fitting 125 can be brought automatically to the proper position because the retainer 135 pushes the projection 128 of the terminal fitting 125 during its oblique movement in the pushing direction PD. If the terminal fitting 125 inserted less than the above insufficiently inserted state, the retainer 135 interferes with the bottom surface of the main portion 126 of the terminal fitting 125 even if an attempt is made to push the retainer 135. Thus, the retainer 135 cannot be pushed any further. Therefore, an operator can detect that the terminal fitting 125 is distant from its proper insertion position.

The terminal fittings 125 may need to be withdrawn for maintenance or other reason. Then, the retainer 135 needs to be returned to the partial locking position. In such a case, a disengagement jig can be inserted into clearances inside the inner surfaces of the side plates 140 of the retainer 135, i.e. the clearance between the operable portions 141 and the cut-away portions 120 to forcibly open the side plates 140 wider. The retainer 135 then is moved back and obliquely downward in this state. When the push-preventing projections 18 are fitted into the guide grooves 142, the retainer 135 can be returned to the partial locking position. The terminal fitting 125 can be withdrawn if the locking portion 5 is disengaged therefrom using another disengagement jig inserted from front of the connector housing 1 in this state.

As described above, according to this embodiment, the retainer 135 moves forward in the retainer mount hole 110 while being moved from the partial locking position to the full locking position. Thus, the retainer 135 can be guided to a specified position at the front end of the retainer mount hole 110 regardless of a variation in the fitted position of the retainer 135. In addition, since the retainer 135 is guided by the engagement of the guide grooves 142 and the locking projections 114 while being moved from the partial locking position to the full locking position, it can be pushed stably and smoothly in the intended direction PD. Thus, the retainer 135 and the terminal fittings 125 are engaged in a proper positional relationship at the full locking position. Therefore, unlike the prior art, the function of the retainer 135 to detect the inserted states of the terminal fittings 125 can be fulfilled securely and the locked state can be obtained.

The retainer mount hole 110 is open in the side surfaces of the connector housing 1 in this embodiment. However, the side plates 140 close these side openings when the mounted retainer 135 reaches the full locking position. Thus, the side plates 140 of the retainer 135 also serve as the outer sidewalls of the housing 1 in this embodiment. Accordingly, the entire connector can narrower than connectors in which the retainer mount hole 110 is not open in the side surfaces and the side plates 140 of the retainer 135 are placed on the side surfaces of the housing 1.

In this embodiment, the cavities 3 at the upper and lower stages in the connector are locked not by separate retainers prepared for the respective stages, but by one retainer at once. Thus, the number of parts and the number of operation steps can be reduced.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

Although the retainer mount hole has the side openings in the housing, it may be open only in the upper surface of the housing.

The guide surfaces are provided at the upper and lower sides of the front and rear edges of the side plates of the retainer in the first embodiment. However, they may be provided on only either front or rear edge or at only either upper or lower side. The guide surfaces need not be provided at the side edges of the side plates and may be at other positions as long as the retainer can be guided obliquely.

Although the guide grooves 42 are in the retainer 35 and the locking projections 14 are provided on the housing 1 in the second embodiment, a reverse arrangement may be adopted.

Although the retainer 35 takes the partly locked state in the second embodiment, it may be directly transferred to the fully locked state without setting the former state.

The hooks 121 and the locking claws 145 form the locking means for holding the retainer 135 fully locked in the second embodiment. The push-preventing projections are designed to contact the outer surfaces of the retainer when the retainer is locked fully, and the retainer can be locked by being tightly held between the locking projections and the push-preventing projections.

The guide grooves 142 may not necessarily be through-grooves, but may be bottomed grooves. Contrary to the second embodiment, the guide grooves may be formed in the connector housing and the locking projections may be provided on the retainer.

What is claimed is:

1. A connector, comprising:

a housing connectable with a mating connector housing, the housing having a top wall, a bottom wall and opposed external sidewalls;

at least one cavity in the housing into which a terminal fitting is insertable in an inserting direction;

a retainer mount hole open at one of the top and bottom walls and both of the external sidewalls along an intermediate position of the housing and communicating with the cavity, the sidewalls each having a recess surrounding a portion of the retainer mount hole that is open at the respective sidewall; and a retainer insertable into the retainer mount hole for engaging and locking the terminal fitting, the retainer having side plates engageable in the recesses of the external sidewalls;

wherein at least one of the retainer and the connector housing comprises a guide means for obliquely guiding the retainer with respect to the inserting direction of the terminal fitting and pushing the terminal fitting to a proper depth in case the terminal fitting has not reached the proper depth, as the retainer is displaced obliquely, and wherein the external sidewalls of the housing have dovetailed undercuts in the recesses, and the retainer has bevels engaging the dovetailed undercuts for holding the side plates of the retainer in the recesses.

2. The connector of claim 1, wherein a portion of the retainer is held substantially in sliding contact with the housing when the retainer is inserted into the retainer mount hole and is formed with the guide means for obliquely guiding the retainer with respect to the inserting direction of the terminal fitting.

3. The connector of claim 1, wherein the cavity is formed substantially along a connecting direction of the connector housings.

4. The connector of claim 3, wherein a resiliently deformable lock is formed to engage the terminal fitting when the terminal fitting is inserted to the proper depth position, such that the lock doubly locks the terminal fitting in cooperation with the retainer.

5. The connector of claim 1, wherein: the retainer is moveable on the housing between a first position where insertion and withdrawal of the terminal fitting is permitted and a second position, where the retainer engages and locks the terminal fitting, a clearance being defined between the retainer and the retainer mount hole so that an inserted state of the terminal fitting into the cavity can be seen when the retainer is at the first position, whereas the clearance is closed by the retainer when the retainer reaches the second position.

6. The connector or claim 1, wherein the housing comprises a plurality of cavities arranged at a plurality of stages, the retainer mount hole communicating with the cavities arranged at the stages, and wherein the retainer locks the terminal fittings into the cavities at each of the stages.

7. A connector, comprising:

a housing connectable with a mating connector housing, the housing having a top wall, a bottom wall and opposed external sidewalls;

top and bottom stages of cavities formed in the housing, the top stage of cavities being adjacent the top wall of the housing and the bottom stage of cavities being adjacent the bottom wall of the cavity, each said cavity being configured for receiving a terminal fitting insertable in an inserting direction;

a retainer mount hole open at one of the top and bottom walls and both of the external sidewalls along an intermediate position of the housing and extending to a sufficient depth for communicating with both the top and bottom stages of cavities; and a retainer insertable into the retainer mount hole, guide means formed on the retainer and the housing for obliquely guiding the retainer with respect to the inserting direction of the terminal fittings and pushing to a proper depth any of the terminal fittings in the top and bottom stages that have not reached the proper depth, and wherein the retainer is movable on the housing between a first position where insertion and withdraw of the terminal fittings is permitted into the cavities of the top and bottom stages and a second position where the retainer engages and locks the terminal fittings in the cavities of both the top and bottom stages.

* * * * *